United States Patent [19]

Petersen

[11] Patent Number: 4,736,941

[45] Date of Patent: Apr. 12, 1988

[54] METHOD AND APPARATUS FOR BRAKING AND DELIVERING PRINTED SHEETS OR SHEET PACKAGES

[75] Inventor: Godber Petersen, Augsburg, Fed. Rep. of Germany

[73] Assignee: Man Roland Druckmaschinen Aktiengessellschaft, Offenbach am Main, Fed. Rep. of Germany

[21] Appl. No.: 941,408

[22] Filed: Dec. 15, 1986

[30] Foreign Application Priority Data

Dec. 20, 1985 [DE] Fed. Rep. of Germany ..... 3545271

[51] Int. Cl.[4] ..... B65H 5/02

[52] U.S. Cl. ..... 271/277; 271/70; 271/186; 271/82; 271/202

[58] Field of Search ..... 271/66, 67, 70, 73, 271/82, 83, 185–187, 307, 312, 315, 275, 277, 202

[56] References Cited

U.S. PATENT DOCUMENTS

| | | | |
|---|---|---|---|
| 854,041 | 5/1907 | Kerra | 271/70 |
| 3,773,322 | 11/1973 | Schlagbauer et al. | 271/315 |
| 4,556,212 | 12/1985 | Nogi et al. | 271/187 |
| 4,629,175 | 12/1986 | Fischer et al. | 271/82 |

FOREIGN PATENT DOCUMENTS

| | | |
|---|---|---|
| 2553518 | 6/1976 | Fed. Rep. of Germany . |
| 2750792 | 5/1979 | Fed. Rep. of Germany . |
| 747444 | 4/1956 | United Kingdom . |

*Primary Examiner*—H. Grant Skaggs

*Attorney, Agent, or Firm*—Frishauf, Holtz, Goodman & Woodward

[57] ABSTRACT

To prevent impact shock of copy elements formed as a single sheet or package of sheets, against grippers of a gripper cylinder which operates at a slower speed than the arrival speed of the copy elements, the grippers of the gripper cylinder engage the leading edges of the arriving copy elements, deflect the leading edges below the plans of arrival and carry the leading edges about the circumference of the gripper cylinder to thereby convert kinetic energy inherent in the copy elements into energy required to cause bending stresses in the copy elements as they are bent about the gripper cylinder, the copy elements, upon rotation of the gripper cylinder, being turned or flipped over, with the trailing edge being guided by sheet-metal guide elements or the like; the sheets are delivered to a delivery apparatus operating at a slower speed than the incoming speed, for example in imbricated or shingled form upon opening of the grippers and delivering the copy elements to the delivery transport belt system upon alignment with an abutment stop.

12 Claims, 5 Drawing Sheets

METHOD AND APPARATUS FOR BRAKING AND DELIVERING PRINTED SHEETS OR SHEET PACKAGES

Reference to related publication documents:
British Pat. No. 747,444,
German Pat. No. 27 50 792.

The present invention relates to handling of printed sheets or sheet packages, hereinafter referred to, collectively, as "copy elements", and more particularly to a method and apparatus for braking of copy elements received at the high rate of speed from a printing machine and which are to be delivered to a delivery apparatus, such as a belt.

BACKGROUND

Copy elements received from a folding former or other folding apparatus are furnished at high speed; it is known to receive these copy elements with a rotating gripper cylinder and to deliver the copy elements in imbricated or shingled form on a delivery mechanism, for example a delivery conveyor belt—see for example the referenced British Pat. No. 747,444. It is also known to use rotating paddle wheels or the like in which the copy elements are received. The paddle wheels have paddles or vanes which receive the furnished copy elements for further handling and delivery. These copy elements, also arriving at high speed, are braked and then placed in imbricated, shingled or overlapping position on delivery belts. These known devices all have the disadvantage that, as the copy elements engage in the respective pockets of the paddle wheels, grippers, or other engagements strips of the rotating cylinders—which, necessarily, must operate at the circumferential speed less than the arrival speed of the copy elements—cause the leading edges of the copy elements to be deformed by compression thereof. Further, it occurs from time to time that the copy elements ricochet at the engagement or abutment elements, grippers or paddle wheels, causing at least partial misfeeds. This disadvantage occurs in rotating elements as well as in arrangements in which belts and the like operating at differential speed and using alignment and braking strips, in accordance with German Pat. No. 27 50 792, are employed.

THE INVENTION

It is an object to provide a method which, preferably, utilizes available well known structures which have only been slightly modified, in which copy elements can be braked after having been supplied at high speed. Additionally, the method and apparatus should be capable of carrying out its function while using only minimum space, and effectively avoiding danger of deformation of the leading edges of the copy elements or bounce-back thereof.

Briefly, the arriving copy elements, which also be referred to as copy substrates, are deflected from their path of arrival in a circular path, by engaging the leading edge of the respective copy element with engagement flaps on a gripper cylinder. These engagement flaps may, merely, be extensions of the grippers of the gripper cylinder. The leading edges of the copy elements, thus, are caught between the gripper cylinder and the engagement flaps without, however, initially engaging the leading edge against the and, or back portions or abutment portions of the gripper elements. The leading edges of the copy elements are thus directed away from their prior path, so that the leading edges are guided about the circumference of the gripper cylinder. The copy elements have a forward momentum which, eventually, will cause the leading edges to abut against the grippers, at which point the grippers will close. Yet, the gripper cylinder, which operates at the slower circumferential speed than the arrival speed of the copy elements, has already rotated over a portion of a revolution, which caused flexing of the copy elements to thereby convert some of the energy which otherwise would be expended on impinging against the grippers into bending of the copy elements. As the gripper cylinder continues to rotate, the copy elements are flipped over due to centrifugal force acting on non-gripped or free portions of the copy elements. This permits the trailing edge of the subtrate of the copy element to overrun the leading edge of the substrate gripped by the grippers of the cylinder due to the kinetic energy still residing in the copy elements. When the gripper cylinder has rotated so that the grippers are adjacent a delivery transport mechanism, typically a delivery belt, the grippers release the now turned-over elements for further distribution. The delivery transport belt, as well as the gripper cylinder, run at a slower speed than the supply speed; the method permits conversion of kinetic energy into bending stresses in the copy elements and prevention of engagement or impinging shock of the leading edge against a gripper abutment which operates at a lower speed.

The basic structure to carry out the method can be conventional, except that the direction of operation of the delivery transport mechanism is reversed with respect to prior art structures, namely counter the direction of rotation of the gripper cylinder; additionally, the grippers are so constructed that they have extending portions which, when open, form deflection elements which guide the incoming leading portion of the copy elements into and toward the grippers without, however, presenting an abutment surface therefor. Additionally, deflection shields or sheets should be provided, for example in the form of sheet-metal deflectors, to guide the incoming copy elements and the trailing portions of the copy elements as they are being flipped over by the gripper cylinder.

In accordance with a feature of the invention, the grippers on the gripper cylinder bend the copy elements before braking the copy elements, that is, before the copy elements impinge with their leading edge against the gripper abutment surfaces themselves. The grippers can be readily controlled to open and close in cadence with rotation of the gripper cylinder, and bending the incoming copy elements by engagement with the open-end portions of the grippers utilizes centrifugal forces being exerted on the copy elements to effectively brake the copy elements while turning them over. The system also permits maintenance of the direction of movement of the copy elements as received and as delivered, although they are delivered, turned over. Selectively, the copy elements may additionally be bent by stationary auxiliary structures, such as deflection shrouds or the like. The leading edges of the copy elements engage the gripper extensions on the gripper cylinders and are deflected downwardly out of their prior supply plane.

The method and apparatus has the advantage with respect to all known braking and aligning and delivery systems that the kinetic energy in the copy elements, as they are being delivered at high speed, is not absorbed by impact engagement resulting in deformation, at the gripper surfaces of the necessarily slower running gripper cylinder; rather, the kinetic energy is converted into bending work and, finally, changes the orientation of the copy element, by turning it over. The arrangement has the additional advantage that, as the copy elements are slowly fitted into the grippers, an air cushion will occur which also will occur behind the copy elements as they are being flipped over, which air cushion or air pillow will also assist in braking and, by compression of the air, absorption of energy, so that the copy elements can be delivered at a speed which is slower than the arrival speed.

DRAWINGS

DETAILED DESCRIPTION

Figure 1:
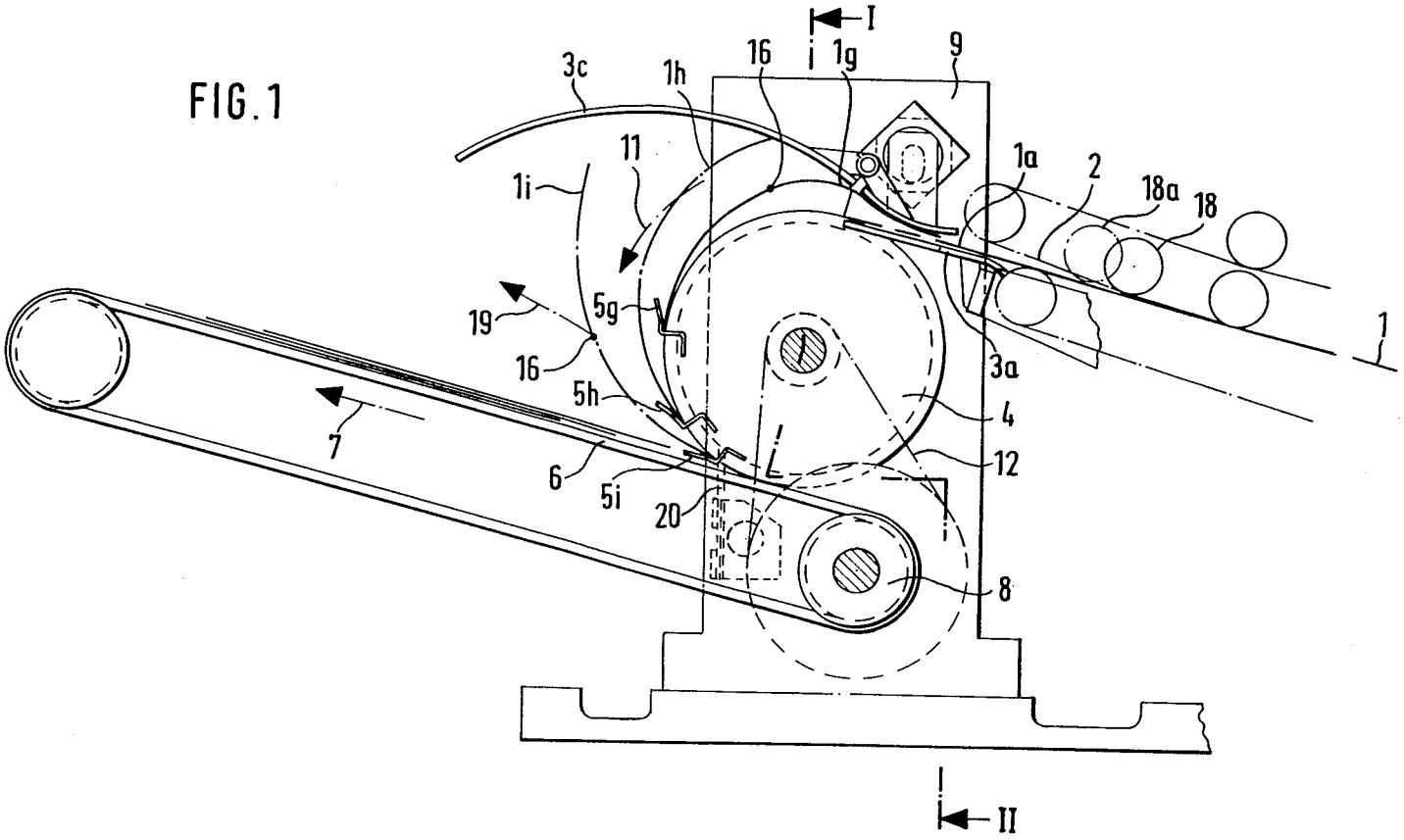
FIG. 1 is a general side view of a braking apparatus carrying out the process in accordance with the invention.
Figure 3:
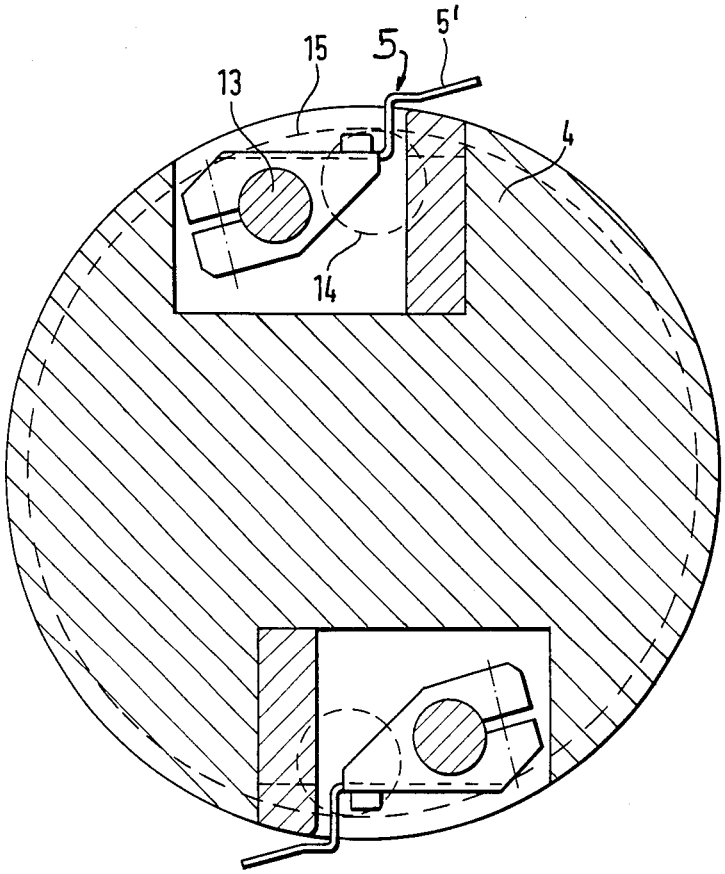
FIG. 3 is a section through the gripper cylinder along the line III—III of FIG. 2.
Figure 4:
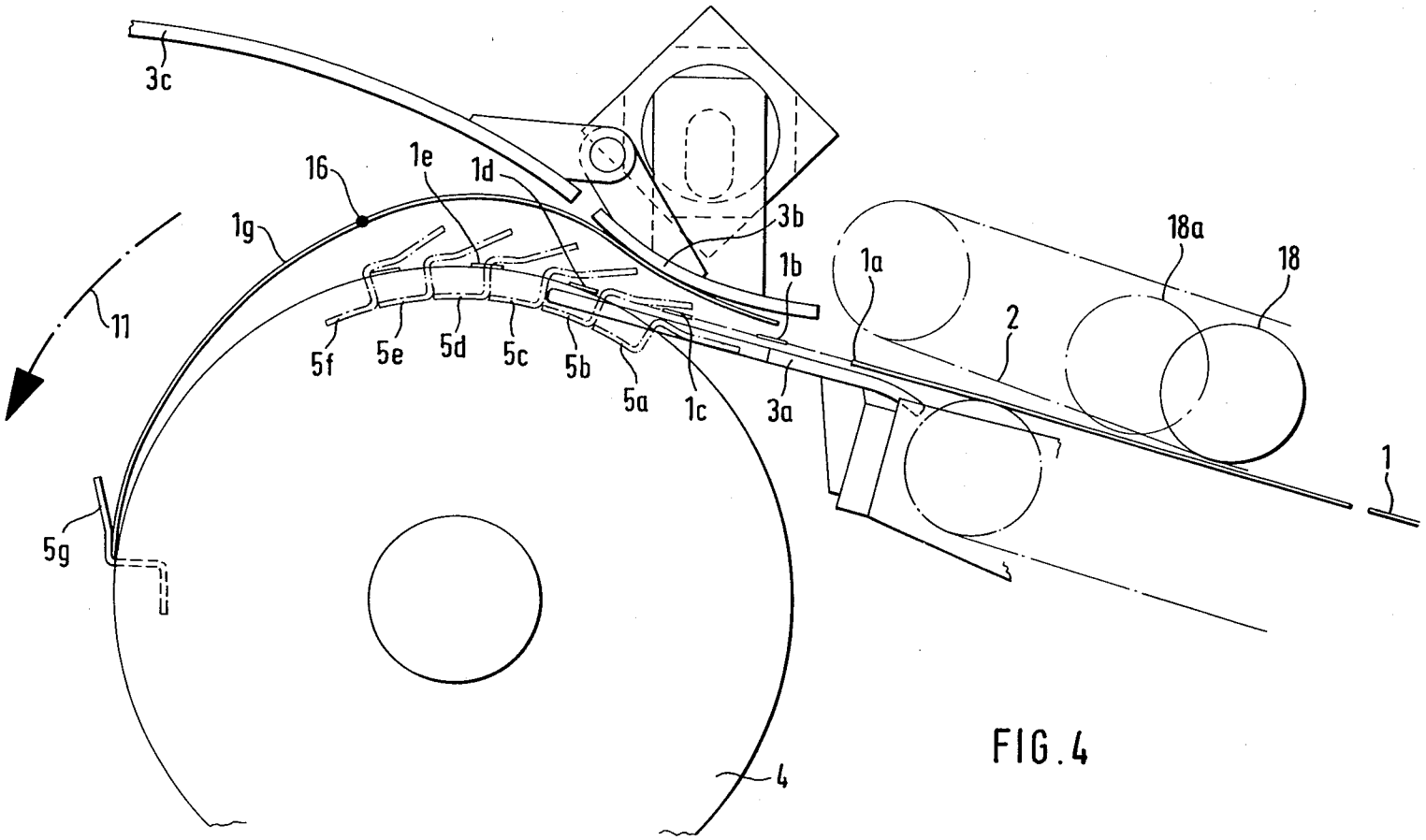
FIG. 4 is an enlarged fragmentary view to illustrate the sequence of acceptance of a copy element by the grippers of a gripper cylinder.
Figure 5:
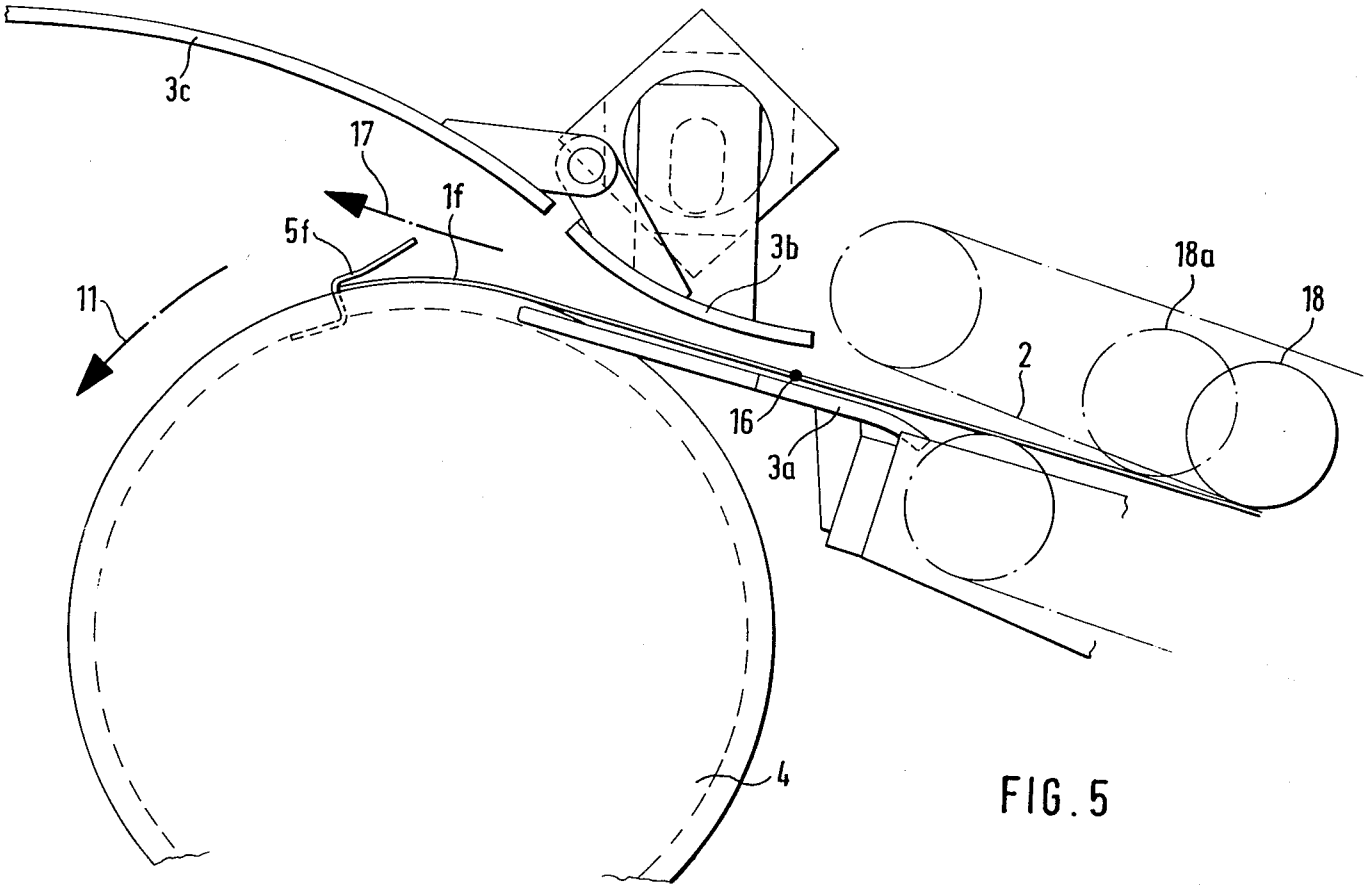
FIG. 5 is an enlarged fragmentary view of the gripper cylinder to illustrate the force relationships arising at the instant of braking of the copy element.

A single sheet or package of sheets, collectively referred to as "copy element" 1, is illustrated in the respective FIGS. 1, 4, 5 in various positions. The various positions of the copy element 1 are illustrated in these respective drawings by the reference numerals 1*a*–1*i*. Referring now to FIGS. 1 and 4: A sheet 1*a* is being supplied to the braking apparatus by a belt transport apparatus, in accordance with well known construction. A supply guide sheet 3*a* guides the copy element 1*a* in an essentially horizontal plane to a rotating gripper cylinder 4. The gripper cylinder 4 has at least one gripper system 5 which extends axially across the gripper cylinder 4 in accordance with well known construction. The gripper system 5—see also FIG. 3—is slightly modified, however, in that the grippers themselves are formed with extension portions 5'. Usually, more than one gripper may be located on the gripper cylinder, and FIG. 3 illustrates, for example, two such gripper systems 5, the lower one in FIG. 3 not being further described since it can be identical to the upper one. Preferably, grippers are formed with relatively long extension or tongs 5' which are used to bend the leading edge of an arriving copy element 1—see FIG. 4, at 1*c*. The gripper positions associated with the respective copy element positions 1*a*–1*i* are identified at 5*a*–5*i*. Of course, the gripper cylinder 4 operates at a lower circumferential linear speed than the arrival speed of the copy elements supplied by the incoming belt system 2.

The position of the leading edge of the copy element is shown and identified by the reference numerals 1*b*–1*f*. In these positions, the leading edge of the copy element gradually approaches the gripper which, further, forms an abutment surface, which can best be seen in FIG. 4 when considering the associated gripper positions 5*b*–5*f*. In accordance with a feature of the invention, the leading edge of the copy element is deflected, in the embodiment shown, deflected downwardly or, in other words, the leading edge is bent or bowed with respect to the remainder of the copy element and, further, bent directly, starting with the position 1*c*. At the position 1*f*, the gripper, at the associated gripper position 5*f*, will actually grip the copy element. The kinetic energy inherent in the copy element, due to its high delivery speed, at first results in an approximately straight-forward directed force which, as seen at 1*g*, further bends the copy element. The force center or force effective point is shown at 16 in FIG. 4. The sheet 1*f*, gripped at the gripper position 5*f*, is guided by the deflection sheets 3*b*, 3*c* and, upon continued transport in the direction of the arrow 11 of the copy element, and while being held with the leading edge in the gripper cylinder 4, the copy element is flipped over or turned by 180°. Thus, the previously trailing end of the copy element becomes the leading end thereof; the original leading end becomes the trailing end, as soon as the copy element is deposited on the delivery belt system 6 at which time the gripper cylinder 4 controls the respective gripper to release the copy element. Since the copy elements arrive at a faster speed, sequentially, and are delivered at a slower speed, the copy elements must overlap, that is, they will be furnished in imbricated or shingled condition. This braking and turning process is particularly advantageous due to the resulting air resistance. As can be seen in FIG. 1, the copy is released, so that it can align itself on stationary engagement tongs or stops 20. Arrow 19, engaged at the center of gravity or center of force engagement, illustrates the direction in which the copy element 1*i* will flip or turn. As schematically indicated by the arrow 19, the resulting kinetic energy will cause the copy element to stretch out, engaging the leading end against the delivery belt 6. Delivery belt 6 operates in the direction of the arrow 7 which is counter the direction of movement of the surface of gripper cylinder 4, i.e., adjacent a delivery position.

Figure 2:
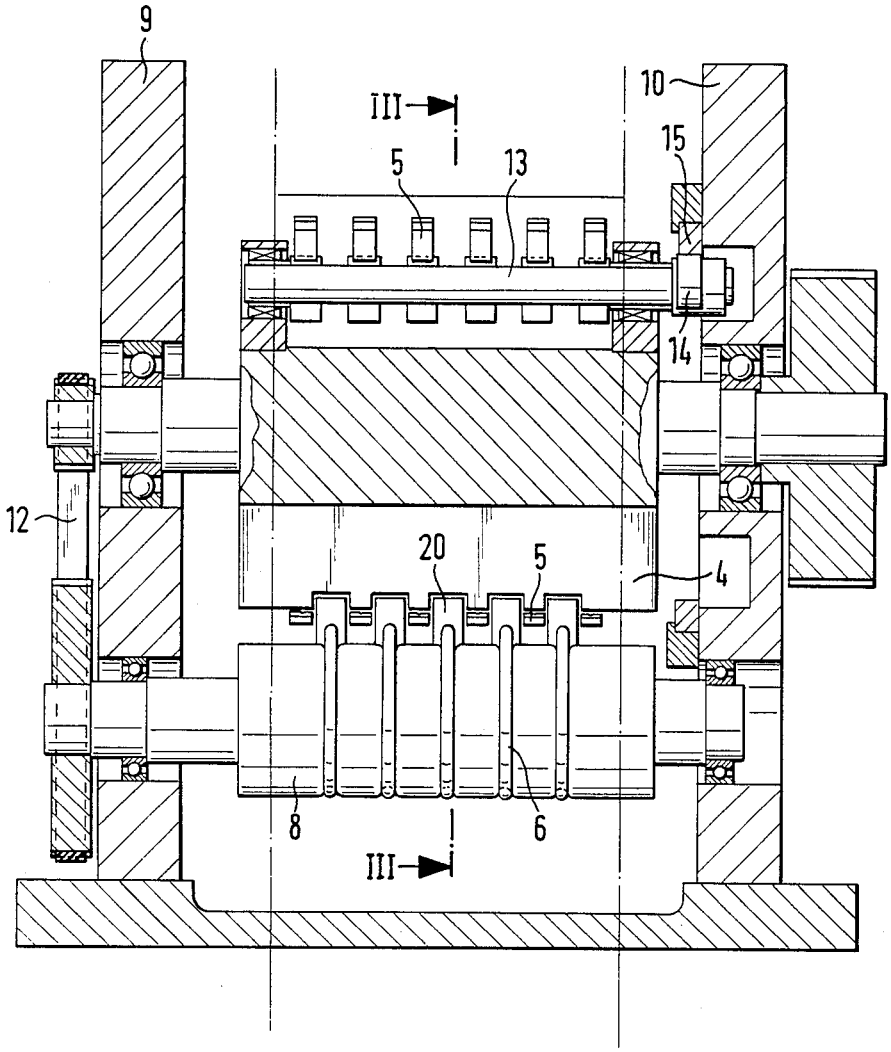
FIG. 2 is a sectional view along the broken section line I–II of FIG. 1.

The gripper cylinder 4 is retained between side walls 9, 10—see FIG. 2. The gripper cylinder 4 is driven in the direction of the arrow 11 (FIG. 1) and, in turn, is coupled over gear belts 12 to a belt roller 8 which controls and causes movement of the delivery belt 6 in the direction of the arrow 7 (FIG. 1). Considering FIGS. 2 and 3 together: Grippers 5 are positioned on gripper spindle 13 which, in turn, are coupled via a cam follower 14 with a cam track 15 to cause, respectively, rotation and opening and closing movement of the grippers 5.

OPERATION

The copy element 1*a*, supplied by the supply belt 2, is braked by the gripper cylinder 4, operating at a slower linear speed; the copy element, additionally, is turned over, and then supplied to the delivery belt 6 which, likewise, operates at slower speed. The delivery is preferably in imbricated or shingled form when the sheets 1 are supplied to the gripper cylinder closely spaced from each other.

As best seen in FIG. 5, engagement of the leading edge of the already bent and deflected copy element 1*f* causes the center of gravity or center of force application 16 to first move in approximately unchanged speed in the direction of the arrow 17. The major portion of the mass of the copy element 1*f* thus does not participate in the impingement force of the leading edge against the gripper 5 when its leading edge engages the gripper—see the sheet 1*f*, FIG. 5. This substantially reduces the danger of damage at the leading edge of the copy element and effectively avoids danger of bounce-back or ricochet of the copy element. Further, the copy element is additionally braked by the air cushion or air pillow, in the direction of its weight, so that its kinetic energy, by compression of the resulting air pillow and the resulting deformation of the copy element itself, will be reduced. As best seen in FIGS. 1 and 4, the copy element is guided by the deflection and guide sheets 3*b*, 3*c*. These guide sheets are, preferably, adjustable in height and deflection angle to match the shape of the bending or bowing copy element to its characteristic—that is, whether the copy element is a single sheet, a plurality of packages of sheets, and the respective strength and bending characteristics of the material of which the sheet or sheets are made. Preferably, at least the level of position of the deflection sheets 3*b*, 3*c* should be adjustable, and the inclination of the sheet 3*c* should be additionally adjustable.

The grippers 5 may begin the opening movement already in advance of the position 5*h*, so that before they reach the position 5*i* in alignment with the abutment elements 20, the copy elements will be released from the grippers. The forces of the copy elements tend to move the copy elements in the direction of the arrow 19 (FIG. 1), which decreases the impact of the copy elements 1*i* on the abutment stops 20. These abutment stops 20 are stationary. Simultaneously, the movement of the sheets, in direction of the arrow 7 of delivery belt 6, is assisted by the force represented by the arrow 19. In some instances, it can be desirable to be able to shift the gripper cylinder forwardly and backwardly to match the transfer steps of the copy elements from the gripper cylinder, such shifting being carried out during rotation of the gripper cylinder, as well known, and not further described herein, since it does not form part of the present invention.

To insure transport of the respective copy elements 1 to the position 1*f*, the roller 18 of the supply belt system 2 is, preferably, shifted forwardly to the position shown in chain-dotted line at 18*a*, that is, if desired in advance of the customary position shown in full line at 18.

Various changes and modifications may be made within the scope of the inventive concept.

I claim:

1. Method of processing printed substrates or copy elements arriving at a distribution station in a first direction and at a first speed, and delivering the printed copy elements to a delivery means (6) at a second speed which is lower than said first speed, wherein the distribution station includes a rotating gripper cylinder (4) operating at a circumferential speed which is slower than said first speed, comprising, in accordance with the invention, the steps of deflecting an arriving copy element (1*c*–1*f*) from the first direction by engaging the leading edge of the copy element (1) with engagement means (5') secured to the gripper cylinder without, however, initially abutting the leading edge of the copy elements against a gripper (5) defining a fixed stop;

guiding said leading edge of the copy element about the circumference of the gripper cylinder (4);

after rotation of said gripper cylinder (4) about a portion of a revolution, and until the leading edge of the copy element (1*f*) has abutted the gripper (5) of the gripper cylinder, closing the gripper (5), said deflection step causing the copy element to bend inwardly toward the gripper cylinder and, in bending, absorption of energy in the copy element and thereby decrease of impact shock of the copy element against the gripper (5), and further causing the trailing edge of the copy element (1*g*) to overrun the leading edge of the copy element gripped by the gripper (5) upon continued rotation of said gripper cylinder (4), due to centrifugal force acting on a portion of the copy element free from the grippers, turning the copy element over; and opening the gripper (5*i*) to release the copy element (1*i*) when the gripper is close to the delivery means (6) and to permit the copy element to be positioned on the delivery means.

2. The method of claim 1, including the step of aligning the leading edge of the copy element after opening of the gripper and release of the copy element against a stationary abutment stop (20).

3. The method of claim 1, including the step of aligning the leading edge of the copy element after opening of the gripper and release of the copy element against a stationary abutment stop (20);

and placing the copy elements in imbricated or shingled arrangement on said delivery means.

4. The method of claim 1, further including the step of guiding the trailing edge of the copy element upon partial leading of the copy element about the circumference of the gripper cylinder (4).

5. The method of claim 4, wherein said guiding step comprises placing deflection elements (3*b*, 3*c*) in the path of the copy element as it is being guided about the gripper cylinder.

6. The method of claim 1, wherein said first direction comprises a delivery direction in a predetermined delivery plane;

and wherein the step of closing the gripper (5*f*) is carried out only after the leading edge of the copy element (1*f*) is at a position below said delivery plane.

7. The method of claim 1, including the step of initially engaging the leading edge of the copy element with a gripper extension or gripper tongue (5') and wherein the step of deflecting the arriving copy element comprises guiding he leading edge of the copy element (1*c*–1*e*) by said extension or tongue of the gripper element.

8. The method of claim 7, including the step of depressing the leading edge of the arriving copy element below a plane defined by the first arriving direction.

9. Apparatus to carry out the method of claim 1, comprising means (2) for supplying printed copy elements (1) at a first speed and in a plane defining a first direction;

means (6) for delivering braked sheets at a second speed slower than said first speed;

and a gripper cylinder (4) operating at a circumferential speed which is slower than said first speed, and having grippers (5) at the circumference thereof, said grippers receiving the arriving sheets;

and wherein, in accordance with the invention, the grippers are formed with extending gripper (5') which, when open, form deflection elements which are oriented and shaped to deflect the arriving copy elements, in the leading region thereof, below said first delivery plane.

10. Apparatus to carry out the method of claim 1, comprising means (2) for supplying printed copy elements (1) at a first speed and in a plane defining a first direction;

a gripper cylinder (4) continuously operating at a circumferential speed which is slower than said first speed, and having grippers (5) at the circumference thereof, said grippers receiving the arriving copy elements and gripping said copy elements when the copy elements abut the grippers at the leading edge of the copy elements, said copy elements being flipped over due to centrifugal force acting on portions thereof free from the gripper; and means (6) for delivering braked sheets at a second speed slower than said first speed received at a delivery position from the gripper cylinder, and wherein said delivery means comprises a continuously operating belt system having a transport direction counter the direction of transport of the copy elements due to rotation of the gripper cylinder (4) at the delivery position.

11. The apparatus of claim 10, wherein the grippers are formed with extending gripper tongues (5') which, when open, form deflection elements which are oriented and shaped to deflect the arriving copy elements, in the leading region thereof, below said first delivery plane.

12. The method of claim 1, wherein the deflection step, during which the trailing edge of the copy element overrides the leading edge comprises flipping the trailing edge over the leading edge during rotation of the gripper cylinder (4) operating at said slower than said first speed and due to the kinetic energy inherent in the copy elements arriving at said first speed.

* * * * *